United States Patent [19]

Wolfe

[11] 4,033,029

[45] July 5, 1977

[54] METHOD OF ASSEMBLING CALIBRATED SWITCH

[75] Inventor: Denis G. Wolfe, Santa Ana, Calif.

[73] Assignee: Robertshaw Controls Company, Richmond, Va.

[22] Filed: Aug. 27, 1976

[21] Appl. No.: 718,288

[52] U.S. Cl. ..... 29/622; 337/112; 337/362

[51] Int. Cl.[2] ..... H01H 11/00

[58] Field of Search ..... 29/622, 630 R, 630 B, 29/630 C, 630 D, 464, 468; 200/275, 283, 61.19; 337/101, 109, 111, 112, 113, 362, 363, 373, 379, 380, 399; 335/154

[56] References Cited

UNITED STATES PATENTS

| | | | |
|---|---|---|---|
| 1,799,651 | 4/1931 | Siegmund | 200/246 |
| 2,248,531 | 7/1941 | Harris | 337/112 X |
| 2,745,924 | 5/1956 | Coates | 337/372 |
| 3,148,258 | 9/1964 | Dales | 337/372 |
| 3,230,607 | 1/1966 | Gelzer | 29/622 |
| 3,670,281 | 6/1972 | Rattan | 337/112 |
| 3,747,208 | 7/1973 | Rattan | 29/622 |
| 3,816,910 | 6/1974 | Jess et al. | 29/622 |

*Primary Examiner*—James R. Duzan
*Attorney, Agent, or Firm*—O'Brien & Marks

[57] ABSTRACT

A wedging member, such as a ball, is frictionally engaged with inclined supporting ends of a pair of contact elements at a calibration temperature. The wedging member retains the positioning of the supporting ends as the temperature is changed from the calibration temperature to a hardening temperature for a hardenable material, such as an inorganic-base chemical-setting cement, for rigidly securing the supporting ends.

8 Claims, 8 Drawing Figures

METHOD OF ASSEMBLING CALIBRATED SWITCH

BACKGROUND OF THE INVENTION

1. Field of the Invention

This invention relates to methods of manufacturing calibrated temperature responsive switches wherein elongated contact elements are secured by hardening a hardenable material around supporting portions of the elements.

2. Description of the Prior Art

In the manufacture of the prior art switches, such as those described in my U.S. Pat. No. 3,913,054, elongated contact elements are secured by hardening a hardenable material around anchor or supporting portions of the contact elements while the contact ends are held in engagement at the calibration or operating temperature of the thermally responsive switch. Hardenable materials, such as the magnesium oxysulfate base cement supplied in powder form by Sauereisen Cements Company, Pittsburgh, Pennsylvania, USA under the designation Plastic Porcelatin No. 30 which is mixed with water when used, are limited to a particular range of temperatures at which the materials can be hardened or cured; for example mixtures of water and inorganic chemical-setting cements generally cannot be set at temperatures in excess of 100° or below 0° C. Thus such prior art thermal switches could only be calibrated at temperatures in the range of the selected hardenable material; for calibration temperatures outside the range of a preferred hardenable material, such as the magnesium oxysulfate and water base mixture, other hardenable materials having higher or lower curing temperatures and which were substantially inferior had to be substituted. For example, thermal setting organic or polymer resins can be selected having setting temperatures substantially above the boiling temperature of water; however such organic materials produce contamination of the contacts from vaporizing, outgassing or decomposition of the organic materials to produce unreliable and defective thermal responsive switches.

U.S. Pat. Nos. 2,745,924, 3,148,258, 3,230,607 and 3,670,281 also disclose processes wherein hardenable materials are cured or hardened to set thermal responsive contact elements at the calibration temperature. The latter U.S. Pat. No. 3,670,281 discloses a gravity biased cylindrical plug having a lower tapered end for engaging the upper ends of contact elements to exert a small force on the contact elements to maintain the contact ends of the elements in engagement during the curing cycle at the desired operating temperature of the switch.

SUMMARY OF THE INVENTION

The invention is summarized in a method of assembling a thermally calibrated switch comprising the steps of supporting a container in an upright position, the container having a pair of elements receiving passages in the bottom thereof; inserting a pair of elongated contact elements through the respective passages with supporting segments of the contact elements extending above the bottom of the container and with contact ends of the elements extending downward from the container, the passages being of sufficient size to allow pivotal movement of the contact ends of the elements together, the pair of contact elements having at least one temperature responsive bimetal portion, further the pair of contact elements being such that the supporting segments are inclined with respect to each other when the contact ends are engaged at a preselected operating temperature which is different from a hardening temperature for a hardenable material; adjusting the temperature of the contact elements to the preselected operating temperature; frictionally engaging the inclined supporting segments of the contact elements with a gravity biased positioning member such that the positioning member is wedged with the supporting segments to oppose movement of the supporting segments during a change of temperature from the preselected operating temperature to the hardening temperature, the frictional engagement exceeding resultant upward forces on the positioning member when the temperature is changed from the preselected operating temperature to the hardening temperature; changing the temperature of the contact elements from the preselected operating temperature to the hardening temperature after the frictionally engaging step; placing a quantity of the hardenable material into the container around portions of the supporting segments of the contact elements; and hardening the quantity of hardenable material at the hardenable temperature to secure the contact elements in a thermally calibrated position.

An object of the invention is to manufacture a thermally responsive switch with temperature responsive contact elements calibrated at a temperature outside the range of the setting or hardening temperatures of the material securing the elements.

Another object of the invention is to manufacture a calibrated switch employing a mixture of an inorganic-base chemical-setting cement with water calibrated at a temperature outside the range from 0° to 100° C.

It is also an object of the invention to manufacture thermal responsive switches without contamination of the contacts due to volatile organic materials and the like.

An advantage of the invention is that the utilization of a gravity biased member frictionally wedged with contact elements at the setting temperature maintains the position of supporting sections of the contact elements as the temperature is changed to a temperature within the setting range of a hardenable material.

One particular feature of the invention is that a rigid sphere or ball is positioned within grooves in upward and outward flaring supporting ends of contact elements whereby the ball moves to a lower position between the contact elements at the calibration temperature and prevents their inward movement during a change of temperature from the calibration temperature to the hardening temperature of a fluid material placed around the elements.

Another advantage of the invention is that thermal switches using a particular superior potting material for the contact elements are no longer limited to calibration temperatures within the range of curing temperatures of the potting material.

Other objects, advantages, and features of the invention will be apparent from the following description of the preferred embodiment taken in conjunction with the accompanying drawings.

DESCRIPTION OF THE PREFERRED EMBODIMENT

Figure 4:
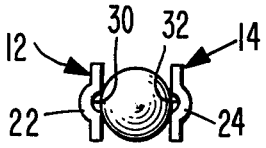
FIG. 4 is a horizontal cross-sectional view of a portion of the switch during the step of FIG. 3.

The present invention is embodied in an improved process for manufacturing a thermal responsive switch of the type disclosed in my U.S. Pat. No. 3,913,054. This type of switch includes a cup shaped container 10 and a pair of elongated contact elements generally indicated at 12 and 14 and extending through respective passages 16 and 18 in the bottom of the container 10 with a quantity of hardened material 20 within the container 10 surrounding portions of the supporting or upper end segments of the contact elements 12 and 14 to form a secure base for rigidly supporting the contact elements 12 and 14. At least one or, as shown, both of the contact elements 12 and 14 include or are formed from elongated bimetal strips wherein the upper end segments extending in the container 10 have respective longitudinal ribs 22 and 24 formed therein to prevent any substantial temperature warp of the upper supporting segments; thus only the lower portions of the elements 12 and 14 warp or bend substantially with temperature changes. Suitable contacts 26 and 28 are mounted on the lower ends of the bimetal strips for engagement and disengagement, as shown in phantom, upon a predetermined temperature change. The upper end segments of the bimetal elements 12 and 14 are inclined apart with respect to each other as they extend upwardly from the bottom of the container 10. Also it is noted that the outwardly facing ribs 22 and 24 formed in the upper end segments of the elements 12 and 14 define longitudinal inward facing grooves 30 and 32, FIG. 4, in the upper end segments of the elements 12 and 14. Electrical conductors 34 and 36 are attached to the upper ends of the contact elements such as by welding, soldering etc. Typically the assembly formed by the container 10 and the contact elements 12 and 14 with the hardened material 20 is mounted within a suitable enclosure such as in a tubular cover 40 having a rolled peripheral groove 42 engaging the lower end of the container 10 to position the contacts ends of the elements 12 and 14 freely within a closed end of the cover 40. The upper end of the cover 40 is sealed with a hardenable material 44 to secure the assembly of container 10 and elements 12 and 14 within the cover 40.

Figure 1:
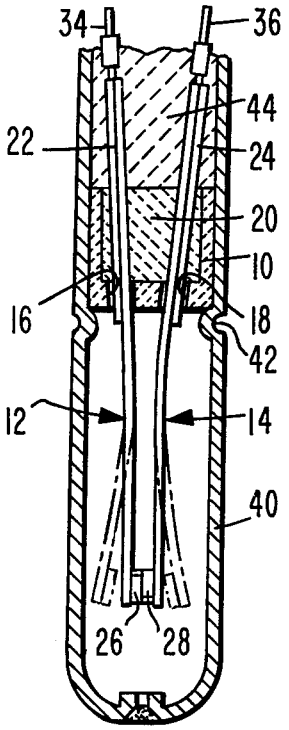
FIG. 1 is a cross-sectional view of a thermal responsive switch manufactured in accordance with the invention.
Figure 2:
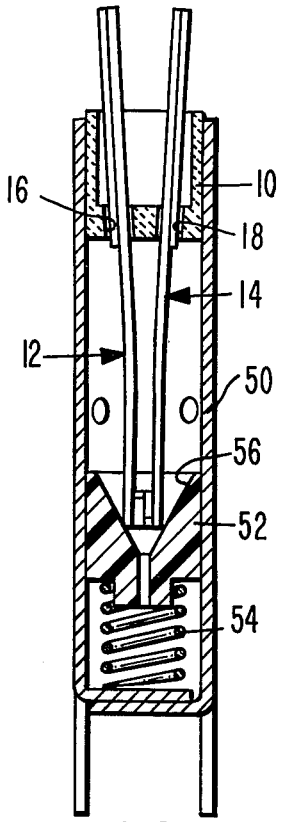
FIG. 2 is a cross-sectional view of a portion of the switch of FIG. 1 in a calibration jig during an intermediate step in the manufacture of the switch.
Figure 3:
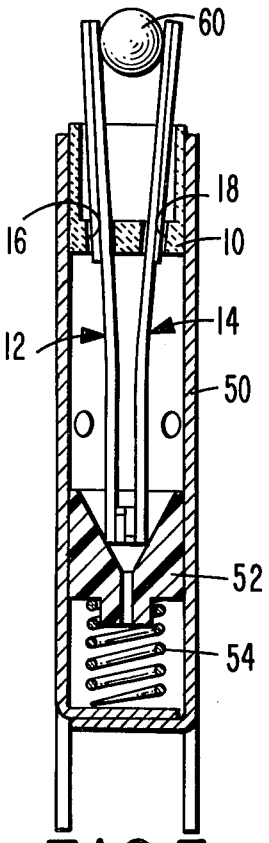
FIG. 3 is a view similar to FIG. 2 but at a later step in the manufacturing process.

In a process of manufacture of such a thermal switch with a preselected operating or calibration temperature at which the switch opens wherein the calibration temperature exceeds the hardening temperature of the hardenable material, the contact elements 12 and 14 are inserted in the passages 16 and 18 of the container 10 and the assembled contact elements and container are inserted into the upper end of a sleeve 50, FIG. 2, of a calibration jig which also has cylindrical aligning plug 52 slideably supported within the bottom of the sleeve by a spring 54. The plug 52 has a conical recess 56 in the upper end thereof for holding the contact ends together in proper alignment. The assembly in the jig is heated to the calibration temperature. With the increase in temperature the warping of the lower portion of the contact elements 12 and 14 cause the upper ends of the elements to pivot further apart. A positioning member such as a rigid ball 60 of steel, ceramic, glass or the like placed between the upper ends of the elements 12 and 14 either before or after heating is seated within the grooves 30 and 32 and assumes a lower position at the calibration temperature. The surface of the ball 60 together with the inside surface of the upper ends of the contact elements 12 and 14 are selected to have a static frictional engagement which is substantially greater than the resultant upward forces on the ball, or the remainder of the upward vector forces applied by the elements 12 and 14 to the ball minus the weight of the ball, when the temperature is lowered to the hardening temperature of the hardenable material. Thus the ball 60 is wedged between the supporting segments of the contact elements to oppose movement of the supporting segments and hold them in their calibration positions at temperatures below the calibration temperature. Subsequently a fluid hardenable material 20 such as a mixture of water and inorganic-base chemical-setting cement is poured into the container 10 and allowed to harden around portions of the supporting segments of the contact elements 12 and 14. Thereafter the ball 60 is removed and the assembly of the container 10 and elements 12 and 14 with the hardened material 20 is assembled with leads 34 and 36 and cover 40 in a conventional manner.

Figure 6:
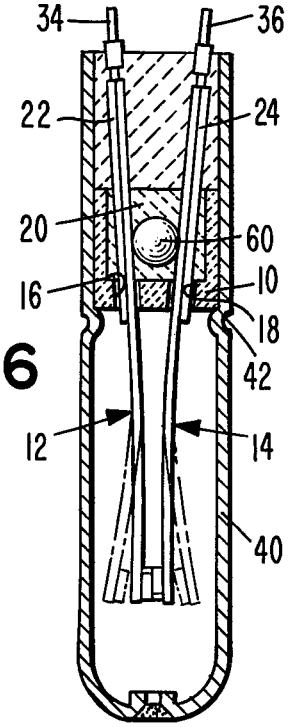
FIG. 6 is a cross-sectional view similar to FIG. 1 of a variation of the thermal responsive switch.
Figure 7:
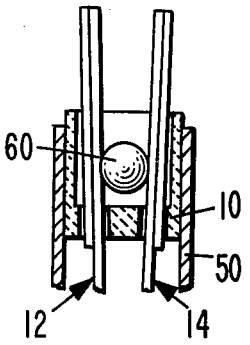
FIG. 7 is a elevational cross-sectional view of an upper portion of the variation of FIG. 6 at an intermediate step of manufacture corresponding to that of FIG. 3.
Figure 5:
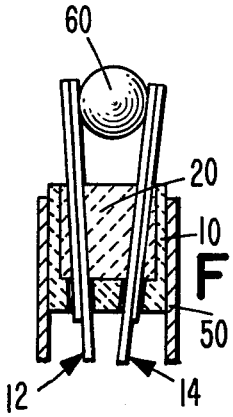
FIG. 5 is a view of a portion broken away from FIGS. 2 and 3 at still a later step in the manufacture of the switch.
Figure 8:
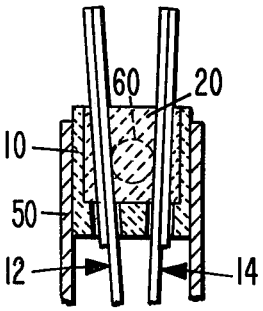
FIG. 8 is a view similar to FIG. 5 but of the variation of FIG. 6.

In a modified method illustrated in FIGS. 6, 7, and 8, the ball 60 is smaller and assumes a lowered position at the calibration temperature between the supporting segments of the elements 12 and 14 within the container 10 whereas in the method illustrated in FIGS. 1-5 the ball 60 is above the container 10. Thus when the cement 20 is poured into the container 10 the ball 60 is covered and remains within the assembly. The ball 60 in the method of FIGS. 6, 7, and 8 is a non-conductive ball such as a ceramic or glass ball to avoid shorting the contact elements.

The process utilizing the gravity biased positioning member 60 in wedging engagement with the supporting segments of the contact elements 12 and 14 permits the manufacture of thermal switches calibrated outside the temperature range within which the matrial 20 can be hardened. For example, the calibration temperature can be 149° C (300° F) and when the member 60 is wedged in place under its weight the temperature can be lowered to 82° C (180° F) whereat the non-volatile inorganic-based chemical-setting cement mixture with water can be used to rigidly mount the supporting segments of the contact elements calibrated at 149° C;

without the use of the positioning member 60, an inferior hardenable material having a hardening temperature range including 149° would have to be used in place of the inorganic-based chemical-setting cement.

Since many modifications, variations, and changes in detail may be made to the above described embodiment it is intended that all matter in the foregoing description and shown in the accompanying drawings be interpreted as illustrative and not in a limiting sense.

I claim:

1. A method of assembling a thermally calibrated switch comprising the steps of supporting a container in an upright position, said container having a pair of element receiving passages in the bottom thereof;

inserting a pair of elongated contact elements through the respective passages with supporting segments of the contact elements extending above the bottom of the container and with contact ends of the elements extending downward from the container, said passages being of sufficient size to allow pivotal movement of the contact ends of the elements together, said pair of contact elements having at least one temperature responsive bimetal portion, further said pair of contact elements being such that the supporting segments are inclined with respect to each other when the contact ends are engaged at a preselected operating temperature which is different from a hardening temperature for a hardenable material;

adjusting the temperature of the contact elements to the preselected operating temperature;

frictionally engaging the inclined supporting segments of the contact elements with a gravity biased positioning member such that the positioning member is wedged with the supporting segments to oppose movement of the supporting segments during a change of temperature from the preselected operating temperature to the hardening temperature, said frictional engagement exceeding resultant upward forces on the positioning member when the temperature is changed from the preselected operating temperature to the hardening temperature;

changing the temperature of the contact elements from the preselected operating temperature to the hardening temperature after the frictionally engaging step;

placing a quantity of the hardenable material into the container around portions of the supporting segments of the contact elements; and hardening the quantity of hardenable material at the hardening temperature to secure the contact elements in a thermally calibrated position.

2. A method of assembling a thermally calibrated switch as claimed in claim 1 wherein the supporting segments of the contact elements are inclined apart in an upward direction, and the gravity biased positioning member is inserted between the supporting segments of the contact elements.

3. A method of assembling a thermally calibrated switch as claimed in claim 2 wherein the supporting segments of the contact elements have longitudinal grooves formed therein, and the gravity biased positioning member is a ball which is guided by the longitudinal grooves in the supporting segments of the contact elements.

4. A method of assembling a thermally calibrated switch as claimed in claim 1 wherein the positioning member is removed after the hardening step.

5. A method of assembling thermally calibrated switch as claimed in claim 1 wherein the gravity biased positioning member is non-conductive and the hardenable material is placed around the gravity biased positioning member to permanently secure the positioning member in the calibrated switch.

6. A method of assembling a thermally calibrated switch as claimed in claim 1 including attaching a pair of leads to the respective supporting segments of the contact elements, and securing the assembled contact elements in an enclosure.

7. A method of assembling a thermally calibrated switch as claimed in claim 1 wherein the hardenable material is a chemical setting mixture of water and an inorganic base cement, the hardenable temperature is within a range from 0° to 100° C, and the preselected operating temperature is outside said range.

8. A method of assembling a thermally calibrated switch as claimed in claim 7 wherein the preselected operating temperature is above 100° C.

* * * * *